US011684083B2

(12) United States Patent
Reimann

(10) Patent No.: US 11,684,083 B2
(45) Date of Patent: Jun. 27, 2023

(54) HEXAGONAL CARTRIDGE HAVING A HEXAGON SHAPED MOUTHPIECE WITH SIX AIR FLOW INLETS

(71) Applicant: Scott Reimann, Greenwood Village, CO (US)

(72) Inventor: Scott Reimann, Greenwood Village, CO (US)

( * ) Notice: Subject to any disclaimer, the term of this patent is extended or adjusted under 35 U.S.C. 154(b) by 583 days.

(21) Appl. No.: 16/806,561

(22) Filed: Mar. 2, 2020

(65) Prior Publication Data

US 2021/0169141 A1 Jun. 10, 2021

Related U.S. Application Data

(60) Provisional application No. 62/945,459, filed on Dec. 9, 2019.

(51) Int. Cl.

| | |
|---|---|
| ***A24F 40/42*** | (2020.01) |
| ***A24F 40/10*** | (2020.01) |
| ***A24F 40/40*** | (2020.01) |

(52) U.S. Cl.

CPC ..... *A24F 40/42* (2020.01); *A24F 40/10* (2020.01)

(58) Field of Classification Search

CPC ..... A24F 40/42; A24F 40/10; A24F 40/40

See application file for complete search history.

(56) References Cited

U.S. PATENT DOCUMENTS

| | | | | |
|---|---|---|---|---|
| 3,200,819 | A | 8/1965 | Gilbert | |
| 4,429,703 | A | 2/1984 | Haber | |
| 9,877,521 | B1 * | 1/2018 | Gillis | A24F 40/42 |
| 2014/0363145 | A1 * | 12/2014 | Plojoux | A61M 11/042 392/386 |
| 2016/0120224 | A1 | 5/2016 | Mishra et al. | |
| 2016/0374395 | A1 * | 12/2016 | Jordan | H02J 7/0044 131/329 |
| 2017/0035115 | A1 * | 2/2017 | Monsees | A61M 15/06 |
| 2017/0215478 | A1 * | 8/2017 | Harrison | A24F 40/40 |
| 2017/0354180 | A1 * | 12/2017 | Fornarelli | H05B 3/04 |
| 2018/0279676 | A1 * | 10/2018 | Kalish | A24F 40/485 |

FOREIGN PATENT DOCUMENTS

| | | | | |
|---|---|---|---|---|
| WO | WO-2019030602 A1 * | 2/2019 | | A24F 40/30 |

* cited by examiner

*Primary Examiner* — Hae Moon Hyeon

(74) *Attorney, Agent, or Firm* — Husch Blackwell LLP

(57) ABSTRACT

A cartridge is disclosed. The cartridge includes an inner tube extending longitudinally, wherein the inner tube defines a channel with a top end and a bottom end, including a liquid substance. The cartridge includes a heat producing component on the bottom end, configured to disperse heat received from a heating element of an inhalation device, wherein the heating element is configured to heat a pre-vapor formulation of the liquid substance to form a vapor. The cartridge includes an outer casing configured to house the inner tube. The outer casing includes a hexagon shaped mouthpiece, on a first end, configured with six air flow inlets. The outer casing includes a hexagon shaped casing connected to a second end, wherein the hexagon shaped casing is configured with at least six release holes.

13 Claims, 5 Drawing Sheets

HEXAGONAL CARTRIDGE HAVING A HEXAGON SHAPED MOUTHPIECE WITH SIX AIR FLOW INLETS

CROSS-REFERENCE TO RELATED APPLICATIONS

This application claims benefit under 35 U.S.C. 119 of U.S. Provisional Application No. 62/945,459, filed Dec. 9, 2019.

FIELD OF THE INVENTION

Example embodiments relate generally to a cartridge. Specifically, an electronic vaping cartridge that may be operable to deliver a pre-vapor formulation from a supply reservoir to a heater. The heater may volatilize the pre-vapor formulation to form a vapor.

BACKGROUND

Electronic vaping (E-vaping) devices provide a smokeless alternative to cigarettes or similar products that work by burning tobacco products. Tobacco based cigarettes or similar products have long been known to cause diseases. Smokeless non-tobacco cigarettes aid to provide a safe and harmless alternative to smoking by replacing burning tobacco and paper to inhale smoke with inhalation of heated, moist, and/or flavored air.

E-vaping devices may be used by adult vapors as a portable means of vaping. Flavor systems within the device may be used to deliver a flavor to the adult vapor along with the vapor that may be produced by the e-vaping device. However, over extended periods of time a loss of flavoring may occur, thereby reducing a shelf-life of the flavoring system. A loss of flavoring may also occur when the flavor system is exposed to a high heat source. Such a loss of flavoring may reduce a sensory experience of the adult vapor.

For instance, U.S. Pat. No. 3,200,819A pertains to a smokeless non-tobacco cigarette that allows the user to smoke either air or medicine instead of tobacco. These cigarettes provide a smokeless non-tobacco cigarette by circulating fluid around a heating element in a turbulent manner to raise the temperature of the inhalant mixture which creates air that approximates that of cigarette smoke. Gilbert states that his smokeless cigarette uses "flavoring preparation" and "moisture" to replace cigarette smoke.

U.S. Pat. No. 4,429,703A pertains to a cigarette substitute which has the appearance of a cigarette which uses an aromatic substance to simulate cigarette smoke.

U.S. Pub. 2016/0120224A1 pertains to an e-vaping cartridge to be used in an e-vaping device. The device draws air through the cartridge. The air is drawn through the cartridge and may absorb flavor.

However, none of the art described above addresses all the issues that the embodiments of the present invention do.

SUMMARY OF THE INVENTION

In order to resolve many of the aforementioned problems, one skilled in the art would appreciate a solution that the hexagonal cartridge discloses. Embodiments of the present invention relate generally to e-vaping apparatuses. Specifically, cartridges and components thereof operable to withhold oils and other substances that are configured to produce a vapor. Accordingly, a cartridge is disclosed. The cartridge includes an inner tube extending longitudinally, wherein the inner tube defines a channel with a top end and a bottom end, including a liquid substance. The cartridge includes a heat producing component on the bottom end, configured to disperse heat received from a heating element of an inhalation device, wherein the heating element is configured to heat a pre-vapor formulation of the liquid substance to form a vapor. The cartridge includes a vapor release component of the bottom end, configured to release a vapor upon being heated by the heat producing component. The cartridge includes an outer casing configured to house the inner tube. The outer casing includes a hexagon shaped mouthpiece, on a first end, configured with a set of air flow inlets. In some embodiments, the set of air flow inlets can comprise of at least 4 air flow inlets. The outer casing includes a hexagon shaped casing connected to a second end, wherein the hexagon shaped casing is configured with at least six release holes.

In one embodiment, the hexagon shaped casing is configured to be in communication with the inner tube, resulting in the liquid substance making contact with the heating element through one or more of the six release holes.

In one embodiment, one or more of the six release holes are positioned on one or more of the sides of the hexagon shaped casing.

In one embodiment, one or more of the six release holes comprises of a circumference of at least 1.2 millimeters (mm).

In one embodiment, the heating element is ceramic.

In one embodiment, the heating element has a resistance of 1.5 ohms and a direct heating function.

In one embodiment, the hexagon shaped casing further comprises 510 threading and configured to be removably attached to a power source or battery. In some examples, the hexagon shaped casing is configured to connect to a battery or power source via a magnet, or via a push down and twist function.

In one embodiment, the inner tube comprises of at least 0.5 milliliter (mL) capacity tank.

In one embodiment, the capacity tank made of glass, and configured to encase a metal atomizer casing and a vapor stem.

In one embodiment, the hexagon mouthpiece is configured to be removably attached to the outer casing with a plurality of threads.

In addition to the foregoing, other objects, features, aspects and advantages of the present invention will be better comprehended through a careful reading of a detailed description provided herein below with appropriate reference to the accompanying drawings.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The accompanying figures are included to provide a further understanding of the invention, and are incorporated in and constitute a part of this specification. The figures illustrate embodiments of the invention and, together with the description, serve to explain the principles of the invention.

The foregoing and other objects, aspects, features, and advantages of the disclosure will become more apparent and better understood by referring to the following description taken in conjunction with the accompanying drawings, in which.

DETAILED DESCRIPTION

Figure 1:
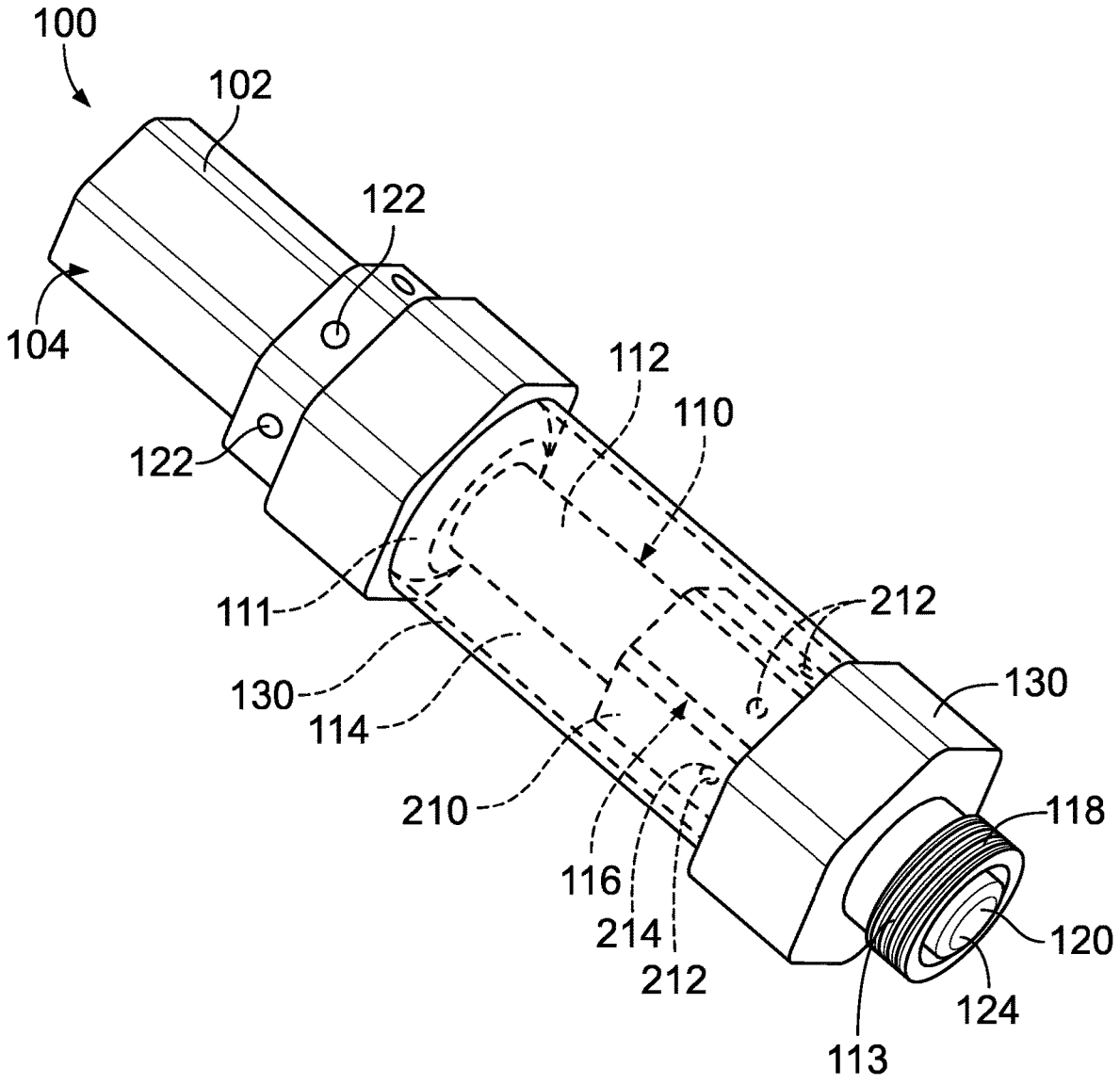
FIG. 1 depicts a perspective view of a cartridge of the e-vaping apparatus, in accordance with an example.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, items, regions, layers and/or sections, these elements, items, regions, layers, and/or sections should not be limited by these terms. These terms are only used to distinguish one element, item, region, layer, or section from another region, layer, or section. Thus, a first element, item, region, layer, or section discussed below could be termed a second element, item, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or items, but do not preclude the presence or addition of one or more other features, integers, steps, operations, elements, items, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

The detailed description set forth below in connection with the appended drawings is intended as a description of the presently contemplated embodiments of the firearm locks and locking systems, and is not intended to represent the only form in which the disclosed invention may be developed or utilized. The description sets forth the various functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second, top and bottom and the like are used solely to distinguish one from another entity without necessarily requiring or implying any actual such relationship or order between such entities. All the terminologies and techniques mentioned herein are not particular to any specific embodiment, and it does not scale down different personifications of our invention. Use of words like "and/or" herein includes all the associated listed items and holds all the combinations of different embodiments. Use of singular form of words like "a/an/the" also associate their plural forms into the context unless otherwise clearly defined for their singular meaning.

All the scientific and technical terms used in this document should be subjected to general understandings of the one with ordinary skills in the field of the invention unless otherwise defined prior. A further understanding is also required to interpret all the terms from the commonly used dictionary reference to the consistency in the contextual background rather than their literal meanings that can create confusion between their idealized and subjective meanings.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 2:
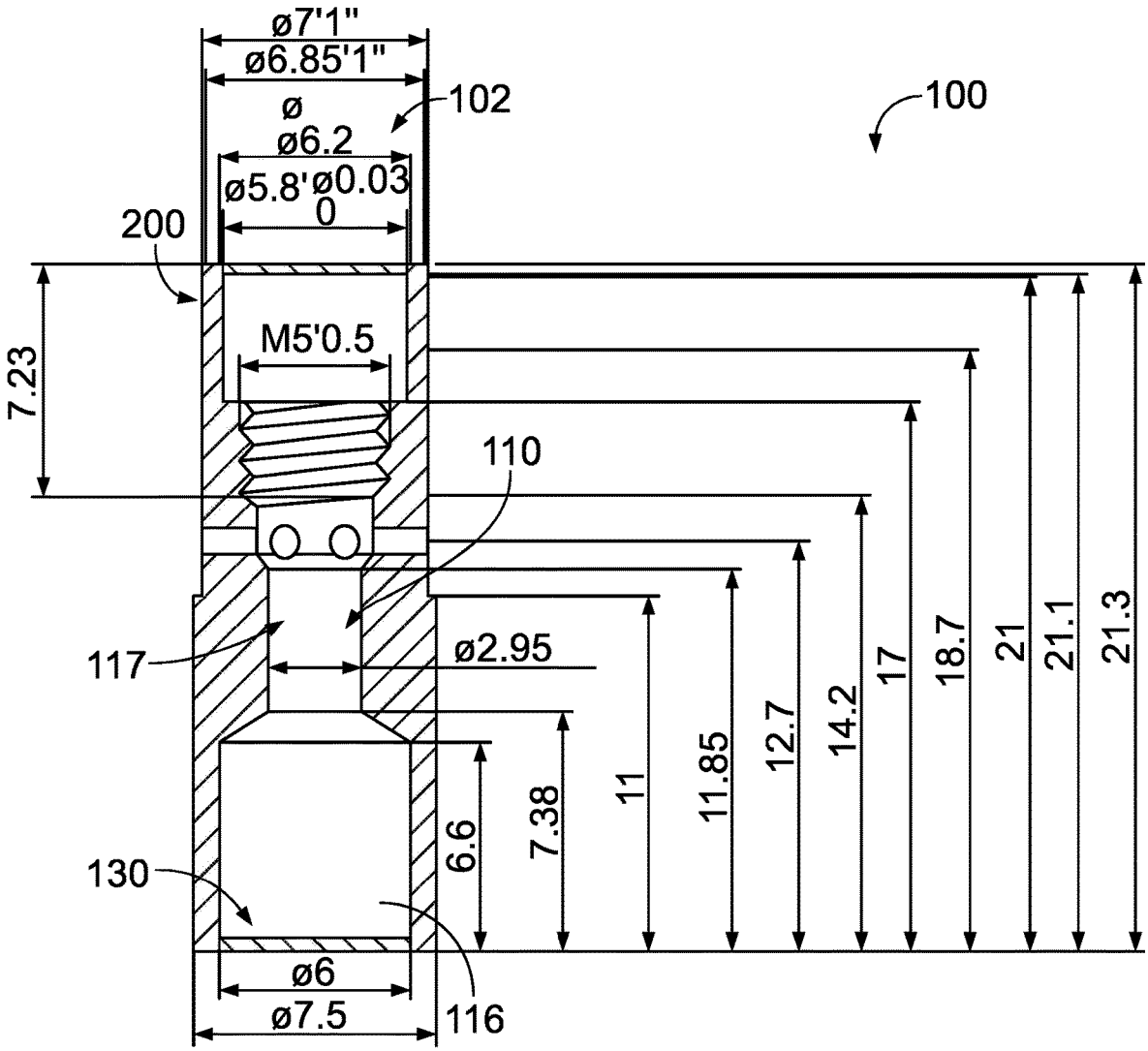
FIG. 2 depicts an internal view of a cartridge within the e-vaping apparatus, in accordance with an example.

Referring to FIG. 1 and FIG. 2, the figures illustrate a cartridge 110 configured to provide a substance or oil to an electronic device 100 or an electronic inhalation device, in one embodiment of the invention. Accordingly, a cartridge 110 for an electronic device or electronic vaping (e-vaping) device is disclosed. The cartridge 110 includes an inner tube 112 extending longitudinally, wherein the inner tube 112 defines a channel 114 with a top end 111 and a bottom end 113, including a liquid substance (not shown). The inner tube 112 comprises of a capacity tank 116 that can be made from a glass, plexi-glass, or heat resistant material. The capacity tank 116 is configured to encase a metal atomizer casing 117 and a vapor stem 144.

In one example, the capacity tank 116 can be made from at least two different capacities ranging from 0.5 mL to 3.0 mL. In some instances, the cartridge 110 can be made of a smaller or larger side, depending on the size of the outer casing 200 of the product.

The liquid substance can be a pre-vapor formulation that may include one or more vapor formers, water, one or more "flavorants" (a compound providing flavor/aroma), and nicotine. For instance, the pre-vapor formulation may include a tobacco-containing material including volatile tobacco flavor compounds which are released from the pre-vapor formulation upon heating. The pre-vapor formulation may also be a tobacco flavor containing material or a nicotine-containing material. Alternatively, or in addition, the pre-vapor formulation may include a non-tobacco material(s). For example, the pre-vapor formulation may include water, solvents, active ingredients, ethanol, plant extracts and natural or artificial flavors. The pre-vapor formulation may further include a vapor former. Examples of suitable vapor formers are glycerine, diols (such as propylene glycol and/or 1,3-propanediol), etc. Because of the diversity of suitable pre-vapor formulation, it should be understood that these various pre-vapor formulations may include varying physical properties, such as varying densities, viscosities, surface tensions and vapor pressures.

The cartridge 110 includes a heat producing component 124 on the bottom end 113, configured to disperse heat received from a heating element 120 of an inhalation device 104, wherein the heating element 120 is configured to heat the pre-vapor formulation of the liquid substance to form a vapor. The heating element 120 can be a ceramic design that is configured to be housed within a housing component, a part of the hexagon shaped casing 210. In some instances the heating element 120 can be in a coil shape, and additionally made with other heating producing metals and conductive materials. Additionally, the ceramic internal heating element 120 can have a resistance of 1.5 ohms and be configured with a direct heating functionality.

Figure 3:
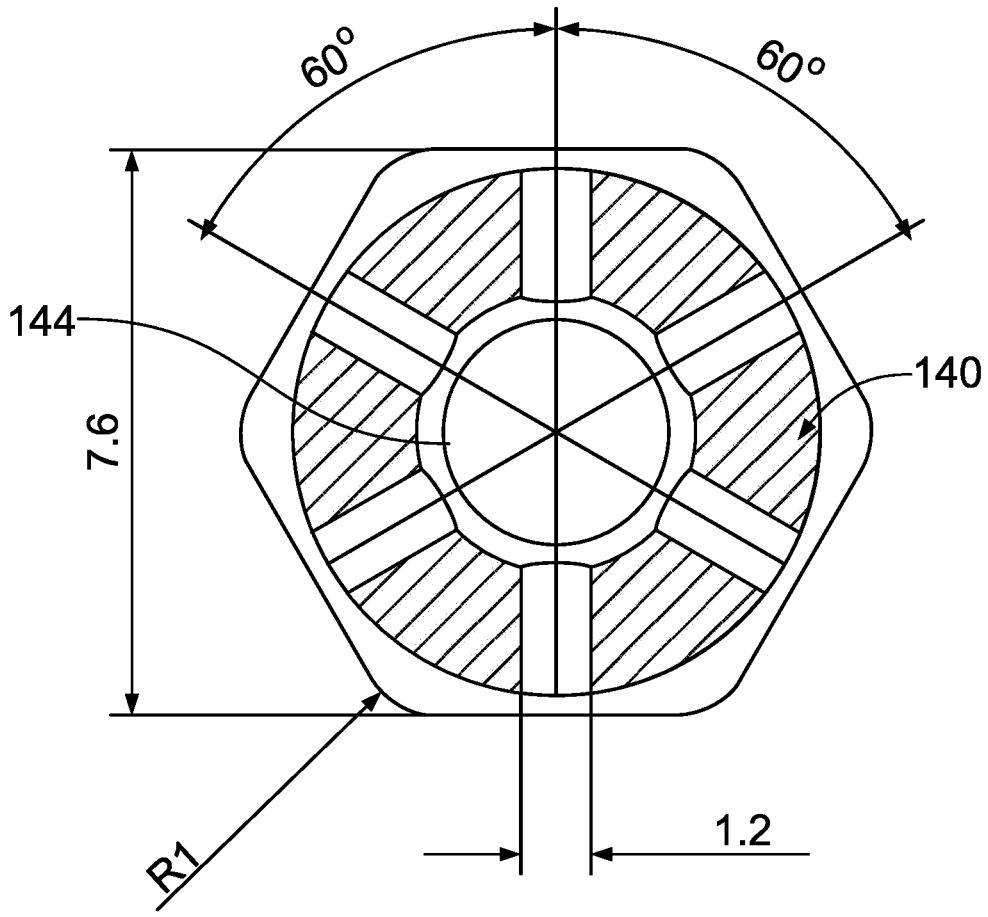
FIG. 3 depicts a top view of a vaper release component, in accordance with an example.
Figure 4:
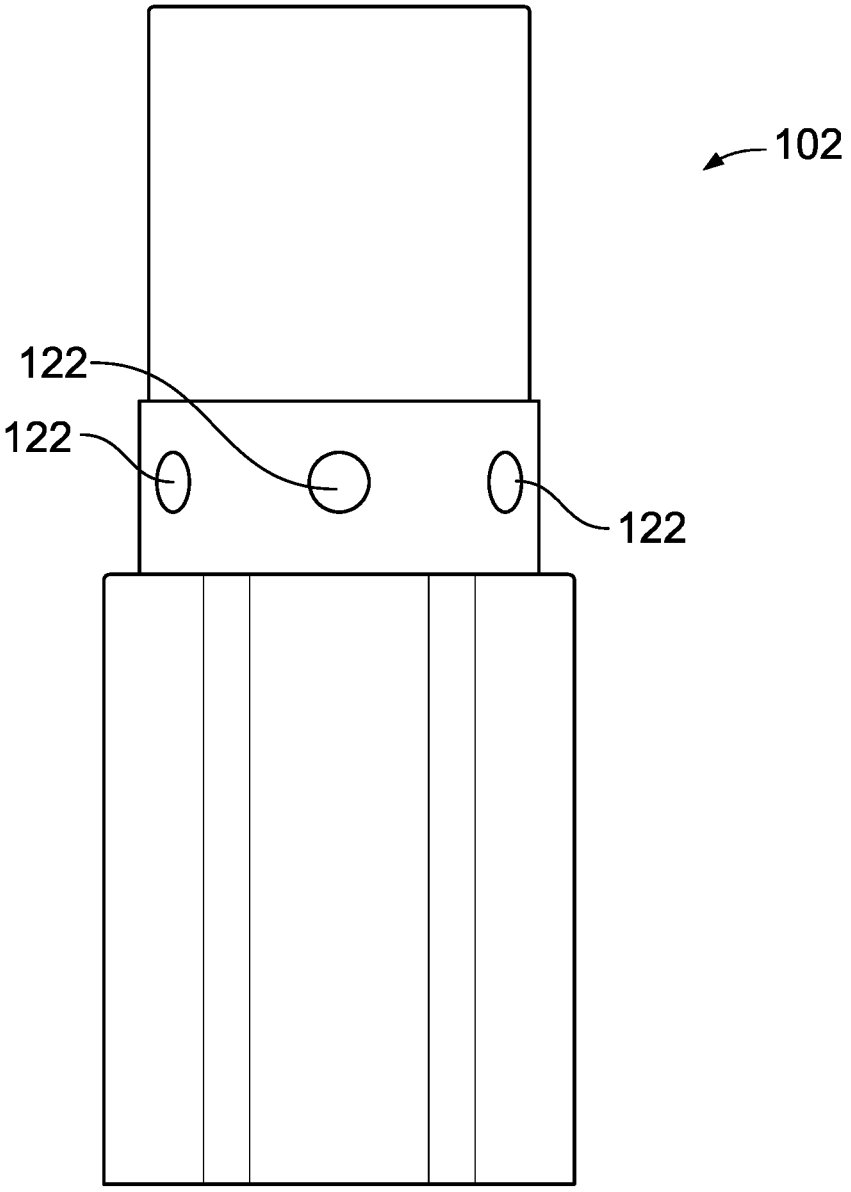
FIG. 4 depicts a perspective view of the mouthpiece of the e-vaping apparatus, in accordance with an example.
Figure 5:
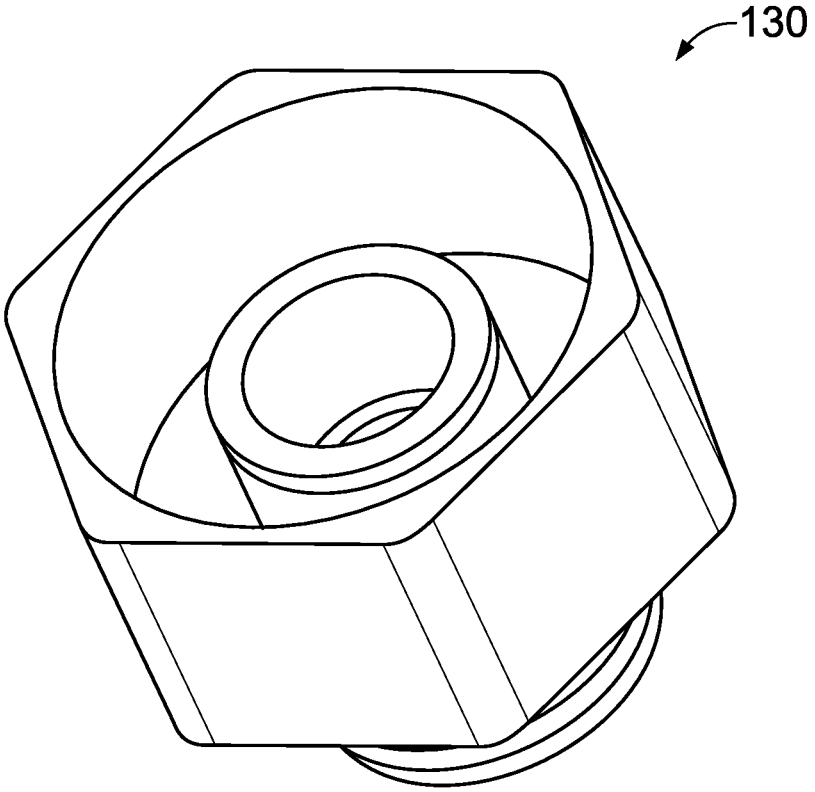
FIG. 5 depicts a perspective view of the cartridge securing end of the e-vaping apparatus, in accordance with an example.

The heating element 120 can comprise of a heater that may extend through a central air passage of the inner tube 112. The heater itself is configured to make aerial or direct contact with the pre-vapor formulation of the liquid substance, or a liquid substance itself. The heater can be predetermined to a set temperature by the user, or set to be one consistent temperature. The heater can further be configured to activate an increased heating temperature based on a draw of air, performed by the user, facilitated by each of the six inlets 122 of the hexagonal mouthpiece 102, as shown in FIG. 3. The draw, caused by the user can cause, an increase airflow of air to be in communication with the heater, causing the heater to ignite a higher temperature.

Alternatively, a heater and wick arrangement can be utilized, where the wick is positioned to extend through the central air passage of the inner tube 112, and provide a consistent heat source to the liquid substance. The heater and wick arrangement can include an electrical heating element 120. The heater portion of the heater and wick arrangement preferably includes an electrically resistive material. The heating element 120 and the associated cartridge are secured by the securing end 130 of the e-vaping apparatus. The securing end 130 is configured to screw on to the e-vaping apparatus in order to secure the heating element 120 to the cartridge 110. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may include doped or undoped ceramics.

In one embodiment, the heater can comprise of electrical leads that may be electrically connected to the heater in order to energize the heater when the device is actively being used by an adult vaper. One or more air inlets may be positioned near an end of a first portion.

A second portion may include a power supply, which may be a battery that is either disposable or rechargeable. The power supply may be operable to apply a voltage across the heater, or directly to the heating element 120 itself, where the amount of heat needed to heat the liquid substance is predetermined by the user. Thus, the heater may volatilize the pre-vapor formulation according to a power cycle of either a time period or a pre-set cycle. In some instances, both the first portion and the second portion can be combined into one section, working interoperable with each other.

In one embodiment, the battery can be a hexagonal shape, wherein the hexagonal shaped battery is configured to prevent the cartridge from rolling off of a smooth surface.

In another embodiment, the cartridge 110 further includes a vapor release component 140 on the bottom end 113 of the cartridge 110. The vapor release component 140 can be configured to release a vapor upon being heated by the heat producing component 124. The cartridge 110 can further include an outer casing 200 configured to house the inner tube 112, as discussed above.

Additionally, the outer casing 200 can include a hexagon shaped mouthpiece 102, on a first end, configured with six air flow inlets 122. Each of the air flow inlets provides the advantage of a smoother draft and vapor flow from the cartridge 110 to a user's mouth. Each of the air flow inlets allows a user to achieve a consistent draft in order to inhale the vapor undisturbed and without interruption of the inner components, while achieving a more consistent heating of the liquid substance within. The mouthpiece 102 is further configured with a plurality of threads to allow for the ability to be removably attached to the cartridge 110 unit. The mouthpiece 102 can further be constructed of a copper metal, any colored metal, ceramic, wood, or an additional heat resistant material. In some embodiments, the tip of the cartridge can also comprise of one or more of a copper metal, any colored metal, ceramic, wood, or an additional heat resistant material.

The outer casing 200 includes a hexagon shaped casing 210 connected to a second end, wherein the hexagon shaped casing 210 is configured with at least six release holes 212. The hexagon shaped casing 210 can be configured to be in communication with the inner tube 112, resulting in the liquid substance making contact with the heating element 120 through one or more of the six release holes 212. In one example, the one or more of the six release holes 212 are positioned on one or more of the sides of the hexagon shaped casing 210 and comprise of a circumference of at least 1.2 millimeters (mm). In another example, the hexagon shaped casing 210 can further comprise of 510 threading and configured to be removably attached to a power source or battery.

In some examples, the hexagon shaped casing 210 is configured to connect to a battery or power source via a magnet, or via a push down and twist function.

The hexagon shaped casing 210 is configured to provide strength and protection to the liquid substance. The hexagon shaped is a shape that has generated a sufficient enough stability and strength in order to prevent rolling, cracking, or further damage to the inner liquid substances.

In one example, each of at least six release holes 212, comprise of corresponding release inlets 214 that comprise of at least six release inlets 214 that are in communication with the inner tube 112 comprising of the liquid substance to be turned to vapor. The combination of the release holes 212 and the release inlets 214 allow for a decrease resistance-to-draw from a user's mouth to release the vapor from the e-vaping device. For example, the resistance-to-draw is the resistance offered by the electronic smoking device, as the smoker (or vaporer) draws on the article. Having an article's resistance-to-draw within an appropriate range can be important for delivering a good smoker experience. The incorporation of at least six release holes 212 and release inlets 214, results in the advantage of an optimized release to draw rate, and allows for a stronger, more consistent draw of vapor from the device 100 to the user's mouth. This result is facilitated by the geometry of the device and the flow rate at which air is drawn into the device. While the flow rate can be controlled by the smoker, the geometry design of the device 100 can be used to achieve a targeted resistance-to-draw (RTD) range and regulate which hole(s) or passage(s) within the device 100 can control the release-to-draw of the device 100.

In accordance with one example, of the above described components, the cartridges 110 can be filled with vape juice, liquid flavored nicotine products, cannabidiol (CBD) and tetrahydrocannabinol (THC) oil, or another liquid substance of the like. The cartridge 110, configured with threads 118 on the bottom end 113, allows a battery or power supply to screw into the cartridge 110 that is filled with the liquid product or substance. The battery is configured to provide power to the cartridge 110, resulting in the coil within the cartridge 110 to heat, and vaporize the oil within the cartridge 110. Accordingly, the heat created by the coil allows a user to inhale, or puff the product through the inhalation device 104, resulting in a vapor being dispensed from the oil, through the mouth piece of the device.

The teachings herein are applicable to electronic cigars, and references to "electronic smoking article(s)" is intended to be inclusive of electronic cigars, electronic cigarettes and the like.

The novel cartridge 110 of the present invention maybe used in devices meant for vaporizing a liquid for sensorial enjoyment or for vaporizing liquid meant to be used as medicament for therapeutic purposes or for vaporizing liquid meant for providing fragrance, i.e., perfumes.

The cartridge 110 of the present device may be used in electronic devices, selected from the group comprising electronic cigarettes, portable charging packs, vaping devices, inhalation devices, preferably electronic cigarettes.

While the above embodiments reflect the use of gels/hydrogels positioned near a distal end of an e-vaping cartridge 110 (where a heater is positioned near a proximal end of the cartridge) of an e-vaping device, it should be understood that the cartridge 110 of the "e-vaping device" may take other forms besides the specific embodiments illustrated above. For instance, the cartridge 110 for the "e-vaping device" may be inclusive of a cartridge 110 for alternative types of e-vaping devices regardless of form, size or shape, and may include a cartridge 110 for electronic hookahs, and the like, where alternative e-vaping devices may include a heater that may volatilize a pre-vapor formulation to form a vapor.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

Although the present invention has been described in terms of various embodiments, it is not intended that the invention be limited to these embodiments. Modification within the spirit of the invention will be apparent to those skilled in the art. For example, the server system can map a client identifier to multiple customers who have recently used the client system. The server system can then allow the user to identify themselves by selecting one of the mappings based preferably on a display of partial applicant-specific application information.

What is claimed is:

1. A cartridge, comprising:

an inner tube extending longitudinally, wherein the inner tube defines a channel with a top end and a bottom end, including a liquid substance;

a heat producing component on the bottom end, configured to disperse heat received from a heating element, wherein the heating element is configured to heat a pre-vapor formulation of the liquid substance to form a vapor;

an outer casing configured to house the inner tube comprising:

a hexagon shaped mouthpiece, on a first end, configured with six air flow inlets; and a hexagon shaped casing connected to a second end, wherein the hexagon shaped casing is configured with at least six release holes, wherein one or more of the six release holes are positioned on one or more of the sides of the hexagon shaped casing.

2. The cartridge of claim 1, wherein the hexagon shaped casing is configured to be in communication with the inner tube, resulting in the liquid substance making contact with the heating element through one or more of the six release holes.

3. The cartridge of claim 1, wherein one or more of the six release holes comprises of a circumference of at least 1.2 millimeters (mm).

4. The cartridge of claim 1, wherein the heating element is ceramic.

5. The cartridge of claim 4, wherein the heating element has a resistance of 1.5 ohms and a direct heating function.

6. The cartridge of claim 1, wherein the hexagon shaped casing further comprises 510 threading and configured to be removably attached to a power source or battery.

7. The cartridge of claim 1, wherein the inner tube comprises of at least 0.5 milliliter (mL) capacity tank.

8. The cartridge of claim 7, wherein the capacity tank made of glass, and configured to encase a metal atomizer casing and a vapor stem.

9. The cartridge of claim 1, wherein the hexagon mouthpiece is configured to be removably attached to the outer casing with a plurality of threads.

10. A hexagonal cartridge, comprising:

an inner tube extending longitudinally, wherein the inner tube defines a channel with a top end and a bottom end, including a liquid substance;

an outer casing configured to house the inner tube;

a heat producing component on the bottom end, configured to disperse heat received from a heating element, wherein the heating element is configured to heat a pre-vapor formulation of the liquid substance to form a vapor; and a hexagon shaped mouthpiece, on a first end of the outer casing configured with six air flow inlets, wherein each air flow inlet is configured to provide air passage from the inner tube, wherein each of the six air flow inlets, draws on the heat producing component, resulting in simultaneously increasing the heating of the vapor.

11. The hexagonal cartridge of claim 10, wherein each of the six air flow inlets simultaneously releases vapor through the mouth piece.

12. The hexagonal cartridge of claim 10, further comprising a hexagonal battery, wherein the hexagonal battery is configured to prevent the cartridge from rolling off of a smooth surface.

13. The hexagonal cartridge of claim 10, wherein the outer casing is a hexagonal shape operable to provide strength and protection to the liquid substance.

* * * * *